US006986262B2

(12) United States Patent
Takasugi et al.

(10) Patent No.: US 6,986,262 B2
(45) Date of Patent: Jan. 17, 2006

(54) BINARY REFRIGERATION UNIT

(75) Inventors: Katsuzi Takasugi, Nitta-Gun (JP); Yuichi Tamaoki, Ora-Gun (JP)

(73) Assignees: Sanyo Electric Co., Ltd., Osaka (JP); Sanyo Electric Biomedical Co., Ltd, Osaka (JP)

( * ) Notice: Subject to any disclaimer, the term of this patent is extended or adjusted under 35 U.S.C. 154(b) by 0 days.

(21) Appl. No.: 10/717,311

(22) Filed: Nov. 18, 2003

(65) Prior Publication Data

US 2004/0118145 A1 Jun. 24, 2004

(30) Foreign Application Priority Data

Nov. 28, 2002 (JP) ..... 2002-345770
Nov. 28, 2002 (JP) ..... 2002-345779
Nov. 29, 2002 (JP) ..... 2002-344709
Nov. 29, 2002 (JP) ..... 2002-347719

(51) Int. Cl.
*F25B 7/00* (2006.01)

(52) U.S. Cl. ..... 62/335; 62/292

(58) Field of Classification Search ..... 62/77, 62/79, 149, 292, 335
See application file for complete search history.

(56) References Cited

U.S. PATENT DOCUMENTS 1,718,312 A * 6/1929 Shipley ..... 62/149
5,339,647 A * 8/1994 Albertson et al. ..... 62/292

* cited by examiner

*Primary Examiner*—William E. Tapolcai
(74) *Attorney, Agent, or Firm*—Darby & Darby

(57) ABSTRACT

With the intention of reducing power consumption and noise, there is provided a binary refrigeration unit which can be started even by a compressor equipped with a small-torque and compact motor. The binary refrigeration unit is constructed in such a manner that an evaporator 4 of a high-temperature side refrigerant circuit H and a condenser 12 of a low-temperature side refrigerant circuit L are disposed side by side, a refrigerant of the low-temperature side refrigerant circuit L is cooled to be condensed at the condenser 12 by vaporization heat of a refrigerant of the high-temperature side refrigerant circuit H evaporated by the evaporator 4, the condensed refrigerant of the low-temperature side refrigerant circuit L is evaporated at an evaporator 14, and accordingly a low temperature much lower than a low temperature obtained by the evaporator 4 is obtained by the evaporator 14. A refrigerant tank 7 is connected to a low-pressure side which is a suction side of a compressor 1 of the high-temperature side refrigerant circuit H through a connecting pipe 6 by interposing a capillary tube 5.

12 Claims, 5 Drawing Sheets

BINARY REFRIGERATION UNIT

BACKGROUND OF THE INVENTION

The present invention relates to a binary refrigeration unit constituted by comprising a high-temperature side refrigerant circuit and a low-temperature side refrigerant circuit.

As a refrigeration unit of this type, for example, as shown in FIG. 6, there is well-known a binary refrigeration unit 100X which is constructed in such a manner that an evaporator 4 as a refrigerant evaporation section of a high-temperature side refrigerant circuit H constituted by serially connecting a compressor 1, a condenser 2, a pressure reducing valve 3 and the evaporator 4, and a condenser 12 as a refrigerant condensation section of a low-temperature side refrigerant circuit L constituted by serially connecting a compressor 11, the condenser 12, a pressure reducing valve 13 and an evaporator 14 are disposed side by side, a refrigerant of the low-temperature side refrigerant circuit L is cooled to be condensed at the condenser 12 by vaporization heat of a refrigerant of the high-temperature side refrigerant circuit H evaporated by the evaporator 4, the condensed refrigerant of the low-temperature side refrigerant circuit L is evaporated at the evaporator 14, and accordingly a low temperature much lower than a low temperature obtained by the evaporator 4 of the high-temperature side refrigerant circuit H is obtained by the evaporator 14 of the low-temperature side refrigerant circuit L (e.g., see Japanese Patent Application Laid-Open No. 2001-91074).

Regarding the low-temperature side refrigerant circuit L, there is well-known a constitution in which a refrigerant tank 17 is connected to its low-pressure side as indicated by a broken line, i.e., a refrigerant suction side of the compressor 11, through a connecting pipe 16 by interposing a capillary tube 15 as pressure reduction means (e.g., see Japanese Patent Application Laid-Open No. 2001-40340).

In the conventional binary refrigeration unit 100X, as shown in FIG. 7, all the devices which constitute the high-temperature side refrigerant circuit H and the low-temperature side refrigerant circuit L are stored in a device storage section of a case 50 formed to a size smaller than a general size of a doorway, e.g., a size of about 770 mm in width, about 900 mm in depth and about 2000 mm in height, so as to be easily carried through a doorway of a general building into a laboratory, a storage room for storing bacteria, blood components, bone marrow, clinical reagents, fungal threads, various cells, sperms, fertilized eggs, nucleic acids, etc., in a cooled state or the like.

A heat exchanger in which the evaporator 4 of the high-temperature side refrigerant circuit H and the condenser 12 of the low-temperature side refrigerant circuit L are disposed side by side to be integrated so as to enable heat exchange between the refrigerants as shown in FIGS. 6, 7 is called as a cascade capacitor.

In the conventional binary refrigeration unit 100X, if the predetermined amount of a nonfluorocarbon refrigerant in which a boiling point is, e.g., about −40° C. per atmospheric pressure, for example, a mixed refrigerant (mass ratio of 94:6) of R407D (15 mass % of R32 (difluoromethane: $CH_2F_2$), 15 mass % of R125 (pentafluoroethane: $CHF_2CF_3$), 70 mass % of R134a (tetrafluoroethane: $CH_2FCF_3$)) and pentane, is sealed in the high-temperature side refrigerant circuit H in order to obtain a low temperature of about −40° C. by the evaporator 4 of the high-temperature side refrigerant circuit H, in the case of a reciprocation type of the compressor 1 which reciprocates a piston in a cylinder to compress the refrigerant, stop equilibrium pressure (pressure when pressure of the refrigerant suction side and pressure of a refrigerant discharge side become equal to each other) reaches even 734 kPa at +35° C. of outside air. If the refrigerant is compressed by the compressor 1, peak pressure of the refrigerant discharge side reaches 2.7 MPa. Consequently, the compressor 1 cannot be started unless motor torque is sufficiently large (in a state in which a temperature of the evaporator is sufficiently reduced, i.e., when the refrigerant smoothly passes through an expansion valve, conveying resistance of the refrigerant is greatly reduced, and thus the compressor is rotated even by small torque).

Accordingly, in the conventional binary refrigeration unit, the compressor equipped with a large motor is used, and there are inconveniences such as (1) large power consumption and (2) large noise. Thus, there is a need to enable starting of even a compressor equipped with a small-torque and compact motor, and this has been a task to be achieved.

SUMMARY OF THE INVENTION

In order to solve the above conventional technical problems, the present invention has been developed.

A first aspect of the present invention is directed to a binary refrigeration unit comprising a refrigerant condensation section of a low-temperature side refrigerant circuit, and a refrigerant evaporation section of a high-temperature side refrigerant circuit disposed side by side with the refrigerant condensation section of the low-temperature side refrigerant circuit, the refrigerant condensation section of the low-temperature side refrigerant circuit being cooled by cold generated at the refrigerant evaporation section of the high-temperature side refrigerant circuit to condense a refrigerant of the low-temperature side refrigerant circuit at the refrigerant condensation section, wherein a refrigerant tank is connected to a low-pressure side of the high-temperature side refrigerant circuit through a connecting pipe equipped with pressure reduction means.

A second aspect of the present invention is directed to the above binary refrigeration unit, wherein a sum of an internal volume of the refrigerant tank and an internal volume of a duct from the pressure reduction means to the refrigerant tank is in a range of 30% to 75% of the entire high-temperature side refrigerant circuit.

A third aspect of the present invention is directed to a binary refrigeration unit comprising a refrigerant condensation section of a low-temperature side refrigerant circuit, and a refrigerant evaporation section of a high-temperature side refrigerant circuit disposed side by side with the refrigerant condensation section of the low-temperature side refrigerant circuit, the refrigerant condensation section of the low-temperature side refrigerant circuit being cooled by cold generated at the refrigerant evaporation section of the high-temperature side refrigerant circuit to condense a refrigerant of the low-temperature side refrigerant circuit at the refrigerant condensation section, wherein a refrigerant tank is connected to a low-pressure side of the high-temperature side refrigerant circuit through a connecting pipe equipped with pressure reduction means; and a high-pressure side of the high-temperature side refrigerant circuit and the refrigerant tank are connected to each other through a bypass pipe equipped with opening/closing means.

A fourth aspect of the present invention is directed to the above binary refrigeration unit, further comprising control means for opening the opening/closing means of the bypass pipe at the time of starting a compressor disposed in the high-temperature side refrigerant circuit, and for closing the opening/closing means after passage of predetermined time or detection of a preset value of a physical amount.

A fifth aspect of the present invention is directed to the above binary refrigeration unit, further comprising control means for opening the opening/closing means of the bypass pipe at the time of stopping the compressor disposed in the high-temperature side refrigerant circuit, and for closing the opening/closing means after passage of predetermined time from a start of the compressor or detection of a preset value of a physical amount.

A sixth aspect of the present invention is directed to a binary refrigeration unit in which a refrigerant condensation section of a low-temperature side refrigerant circuit and a refrigerant evaporation section of a high-temperature side refrigerant circuit housed in a case are disposed side by side; and the refrigerant condensation section of the low-temperature side refrigerant circuit is cooled by cold generated at the refrigerant evaporation section of the high-temperature side refrigerant circuit to condense a refrigerant of the low-temperature side refrigerant circuit at the refrigerant condensation section, the binary refrigeration unit comprising a high-temperature side refrigerant tank connected to a low-pressure side of the high-temperature side refrigerant circuit through pressure reduction means; and a low-temperature side refrigerant tank connected to a low-pressure side of the low-temperature side refrigerant circuit through pressure reduction means, wherein one refrigerant tank is installed in the case; and the other refrigerant tank is attached to a backside of the case.

A seventh aspect of the present invention is directed to the above binary refrigeration unit, wherein the refrigerant tank of the high-temperature side or the low-temperature side attached to the backside of the case is divided into plural portions.

An eighth aspect of the present invention is directed to the above binary refrigeration unit, wherein the low-temperature side refrigerant tank is installed in the case; and the high-temperature side refrigerant tank is attached to the backside of the case.

A ninth aspect of the present invention is directed to the above binary refrigeration unit, wherein a wall abutting member whose rear end is positioned in the rear of the refrigerant tank attached to the backside of the case is attached to the backside of the case.

A tenth aspect of the present invention is directed to a binary refrigeration unit in which a refrigerant condensation section of a low-temperature side refrigerant circuit and a refrigerant evaporation section of a high-temperature side refrigerant circuit housed in a case are disposed side by side, and the refrigerant condensation section of the low-temperature side refrigerant circuit is cooled by cold generated at the refrigerant evaporation section of the high-temperature side refrigerant circuit to condense a refrigerant of the low-temperature side refrigerant circuit at the refrigerant condensation section, the binary refrigeration unit comprising a high-temperature side refrigerant tank connected to a low-pressure side of the high-temperature side refrigerant circuit through pressure reduction means; and a low-temperature side refrigerant tank connected to a low-pressure side of the low-temperature side refrigerant circuit through pressure reduction means, wherein one refrigerant tank is installed in the case; and the other refrigerant tank is mounted on a tank mounting member rotatably mounted on a backside of the case to be rotatably attached to the backside of the case.

An eleventh aspect of the present invention is directed to the above binary refrigeration unit, wherein a connecting pipe extended from the low-pressure side of the high-temperature side refrigerant circuit or the low-temperature side refrigerant circuit through a back plate of the case is connected through a loop to the refrigerant tank attached to the backside of the case.

A twelfth aspect of the present invention is directed to the above binary refrigeration unit, wherein the refrigerant tank of the high-temperature side or the low-temperature side attached to the backside of the case is divided into plural portions.

A thirteenth aspect of the present invention is directed to the above binary refrigeration unit, wherein the low-temperature side refrigerant tank is installed in the case; and the high-temperature side refrigerant tank is attached to the backside of the case.

A fourteenth aspect of the present invention is directed to the above binary refrigeration unit, wherein a wall abutting member whose rear end is positioned in the rear of the refrigerant tank attached to the backside of the case is attached to the backside of the case.

BRIEF DESCRIPTION OF THE DRAWINGS

FIG. 3A being an explanatory view when a refrigerant tank is not rotated, and FIG. 3B being an explanatory view when the refrigerant tank is rotated;

FIG. 4A being an explanatory view when the refrigerant tank is not rotated, and FIG. 4B being an explanatory view when the refrigerant tank is rotated;

DETAILED DESCRIPTION OF THE PREFERRED EMBODIMENTS

Figure 6:
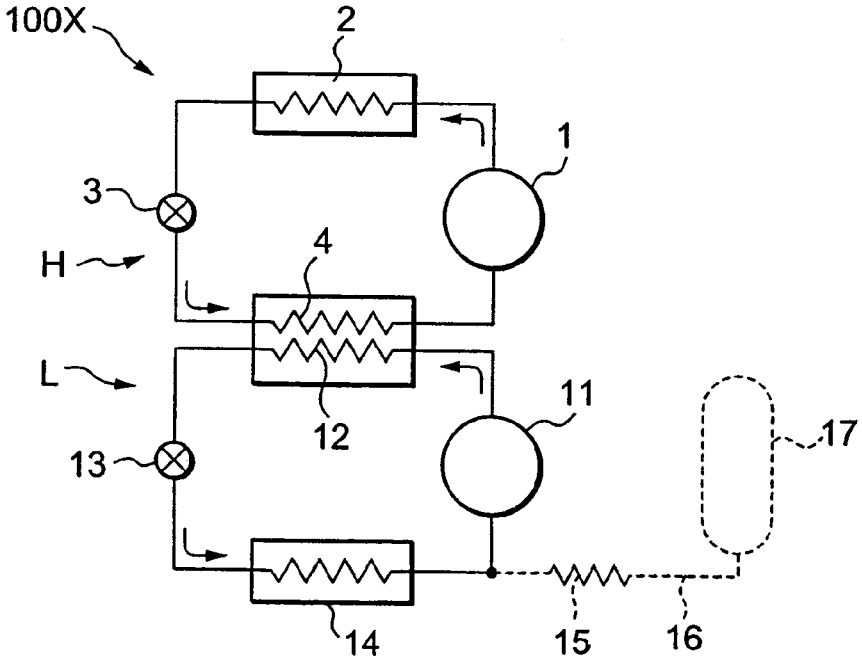
FIG. 6 PRIOR ART
FIG. 6 is an explanatory view showing a conventional art.

Next, a first embodiment of the present invention will be described in detail with reference to FIG. 1. For easier understanding, portions having functions similar to those of the portions shown in FIG. 6 are denoted by similar reference numerals in FIG. 1.

Figure 1:
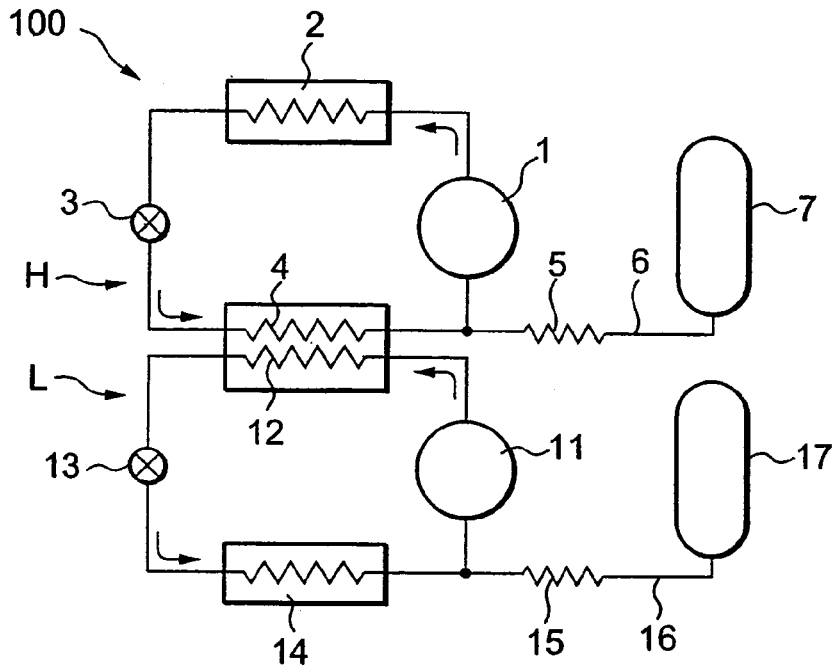
FIG. 1 is an explanatory view showing a first embodiment of the present invention.

In a high-temperature side refrigerant circuit H of a binary refrigeration unit 100 of the present invention shown in FIG. 1, a compressor 1, a condenser 2, a pressure reducing valve 3 and an evaporator (refrigerant evaporation section) 4 are serially connected to form a circulation path of a refrigerant. A refrigerant tank 7 is connected to a low-pressure side of the circuit, i.e., a suction side of the compressor 1, through a connecting pipe 6 by interposing a capillary tube 5 as pressure reduction means.

A sum of an internal volume of the refrigerant tank 7 and an internal volume of the connecting pipe 6 from the capillary tube 5 to the refrigerant tank 7 is, e.g., 45% of a total internal volume of the high-temperature side refrigerant circuit H in the case of the binary refrigeration unit 100. The high-temperature side refrigerant circuit H is filled with the predetermined amount of a mixed refrigerant in which R407D and pentane are mixed at a mass ratio of 94:6 so as to set a boiling point to about −45° C. per atmospheric pressure, and equilibrium pressure is adjusted to 658 kPa at +35° C. of outside air during a stop of an operation.

On the other hand, R508A (mixed refrigerant in which R23 and R116 (hexafluoroethane) as FC containing only fluorine and carbon are mixed at a mass ratio of 39:61) which boiling point is about −86° C. per atmospheric pressure is sealed in a low-temperature side refrigerant circuit L in which a compressor 11, a condenser (refrigerant condensation section) 12, a pressure reducing valve 13 and an evaporator 14 are serially connected, and a refrigerant tank 17 is connected to a refrigerant suction side of the compressor 11 through a connecting pipe 16 by interposing a capillary tube 15.

Hard alkyl benzene oil (HAB oil) is injected as refrigerating machine oil in the compressor 1 of the high-temperature side refrigerant circuit H and the compressor 11 of the low-temperature side refrigerant circuit L to improve lubricity, airtightness etc., on sliding portions of the compressors.

The binary refrigeration unit 100 of the present invention is constructed in such a manner that the evaporator 4 of the high-temperature side refrigerant circuit H and the condenser 12 of the low-temperature side refrigerant circuit L are disposed side by side, and a refrigerant of the low-temperature side refrigerant circuit L can be cooled to be condensed at the condenser 12 by vaporization heat of a refrigerant of the high-temperature side refrigerant circuit H evaporated by the evaporator 4.

In the binary refrigeration unit 100 of the invention constructed in the foregoing manner, the mixed refrigerant of R407D and pentane is sealed in the high-temperature side refrigerant circuit H so that the equilibrium pressure can become 658 kPa (equilibrium pressure exceeds 700 kPa in the case of the conventional binary refrigeration unit 100X) at +35° C. of outside air during the stop of the operation. Thus, even if a compressor of a reciprocation type which reciprocates a piston to compress a refrigerant is used for the compressor 1 of the high-temperature side refrigerant circuit H, no large load is applied when the compressor 1 is stated.

In the conventional binary refrigeration unit 100X, it is necessary to use the compressor 1 which comprises, e.g., a motor of a rated voltage 220 V and rated consumption power 750 W. However, according to the binary refrigeration unit 100 of the invention, the operation can be started by the compressor 1 which comprises, e.g., a compact motor of a rated voltage 115V and rated consumption power 600 W, and it is accordingly possible to reduce both of the amounts of power consumption and noise.

After the start of the compressor 1, a refrigerant stored in the refrigerant tank 7 is gradually moved through the capillary tube 5 to the suction side of the compressor 1 to be used for a refrigeration operation. That is, after the compressor 1 is stated, most of refrigerants stored in the refrigerant tank 7 are sucked through the connecting pipe 6 to the compressor 1.

Thus, the amount of a refrigerant compressed by the compressor 1 to be discharged, condensed at the condenser 2 and evaporated at the evaporator 4 is increased to a level approximately equal to that of the conventional binary refrigeration unit 100X when a refrigerant is sealed in the high-temperature side refrigerant circuit H so that stop equilibrium pressure can exceed 700 kPa, and high torque is required for starting the compressor 1. Accordingly, at the evaporator 4, sufficiently low cold of about −45° C. can be surely obtained as in the conventional case.

As a low temperature up to about −86° C. can be surely obtained at the evaporator 14 of the low-temperature side refrigerant circuit L, the binary refrigeration unit 100 of the invention can be used as a device for storing bacteria, blood components, bone marrow, clinical reagents, fungal threads, various cells, sperms, fertilized eggs, nucleic acids etc., in a cooled state.

When the operation of the compressor 1 is stopped, a refrigerant is sucked from the low-pressure side, and supplying of a condensed high-pressure refrigerant to the high-pressure side is no longer continued, the compressed refrigerant present on the high-pressure side is moved through the expansion valve 3 to the evaporator 4 side. Thus, pressure of the high-pressure side is reduced while pressure of the low-pressure side is increased.

The pressure increase of the low-pressure side is caused by supplying of a high-pressure refrigerant from the high-pressure side through the expansion valve 3 to the low-pressure side. Consequently, the pressure increase of the low-pressure side is accompanied by a loss of pressure balance between the evaporator 4 side and the refrigerant tank 7 side communicated with each other through the capillary tube 5, and pressure of the evaporator 4 side becomes higher than that of the refrigerant tank 7 side. Thus, a high-pressure refrigerant present on the evaporator 4 side is moved through the capillary tube 5 to the refrigerant tank 7 side to be stored in the refrigerant tank 7. Then, the evaporator 4 side and the refrigerant tank 7 side of the low pressure-side pressure, and high-pressure side pressure in the high-temperature side refrigerant circuit H become the same pressure, i.e., 658 kPa which is stop equilibrium pressure (at +35° C. of outside air).

The present invention is not limited to the aforementioned embodiment. Various changes can be made without departing from its spirit and scope.

For example, for a sum of an internal volume of the refrigerant tank 7 and an internal volume of the connecting pipe 6 from the capillary tube 5 to the refrigerant tank 7, unless at least 30% or higher of a total internal volume of the high-temperature side refrigerant circuit H is secured, it is impossible to obtain an operation effect that the compressor 1 equipped with the small-torque motor can be stated.

However, since not only no further operation effect can be expended but also a large tank must be installed even if the sum exceeds 75%, the sum is limited in a range of 30% to 75% of the total internal volume of the high-temperature side refrigerant circuit H in terms of cost effectiveness and installation easiness.

As a refrigerant which fills the high-temperature side refrigerant circuit H, R218 which is FS containing only fluorine and carbon (8-propane fluoride, boiling point is −36.7° C. per atmospheric pressure), R1270 (propylene), R290 (propane) or the like may be used.

As a refrigerant which fills the low-temperature side refrigerant circuit L, R744A (nitride suboxide), R170 (ethane), a mixed refrigerant of R740 (argon), R50 (methane), R14 (tetrafluoromethane) and R23 (trifluoromethane) or the like may be used.

As refrigerating machine oil injected into the compressor 1 of the high-temperature side refrigerant circuit H and the compressor 1 of the low-temperature side refrigerant circuit L, natural mineral oil or chemosynthetic oil such as ester oil, ether oil or silicon oil is preferred.

The capillary tubes 5, 15 may be replaced by pressure reducing valves such as electronic expansion valves or manual expansion valves.

As described above, according to the present invention, since the operation can be started even by the compressor which comprises the smaller-torque and compact motor, it is possible to reduce power consumption and noise.

Next, a second embodiment of the present invention will be described in detail with reference to FIG. 2. For easier understanding, portions having functions similar to those of the portions shown in FIG. 6 are denoted by similar reference numerals in FIG. 2.

Figure 2:
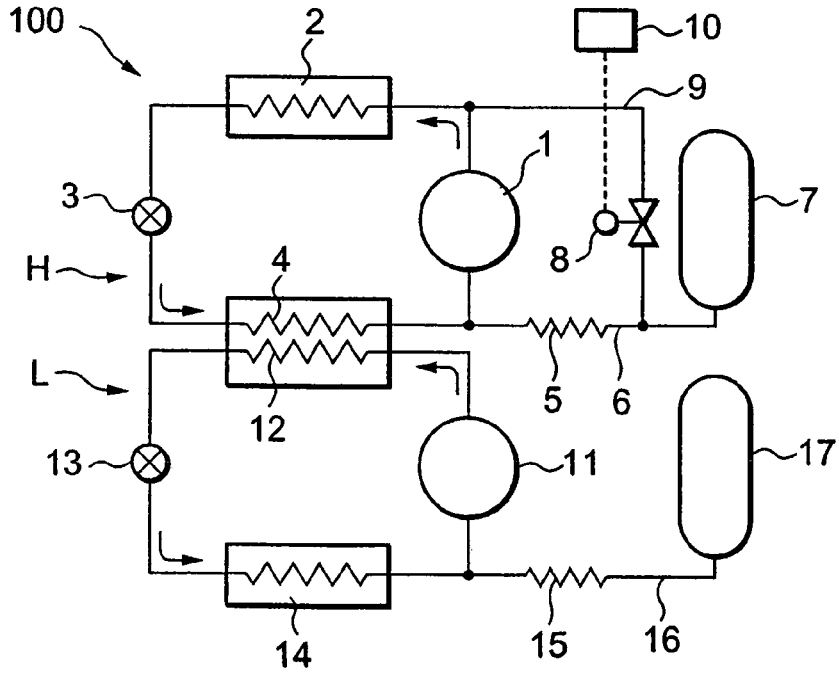
FIG. 2 is an explanatory view showing a second embodiment of the present invention.
Figure 3B:
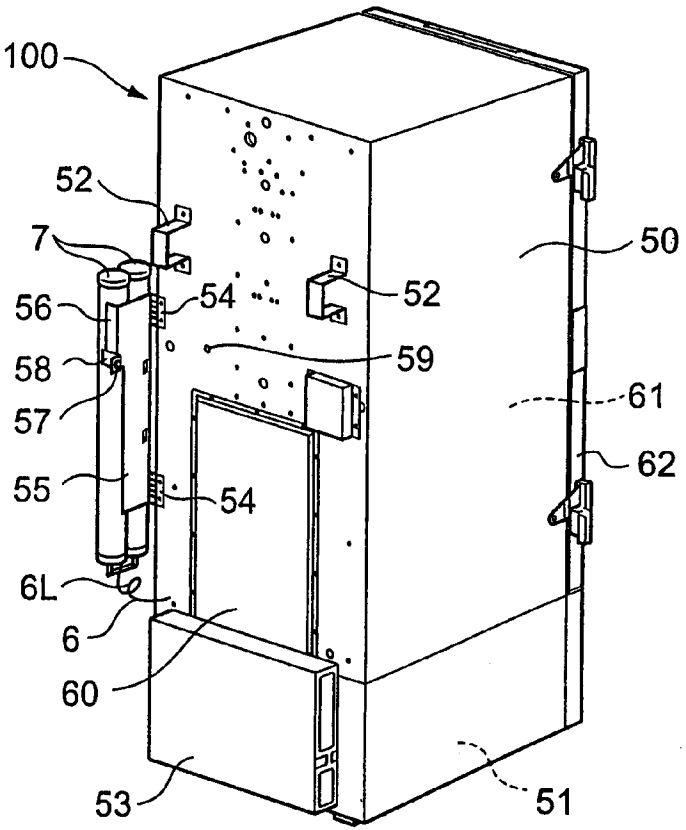
FIGS. 3A and 3B are perspective explanatory views showing a third embodiment of the present invention.
Figure 3A:
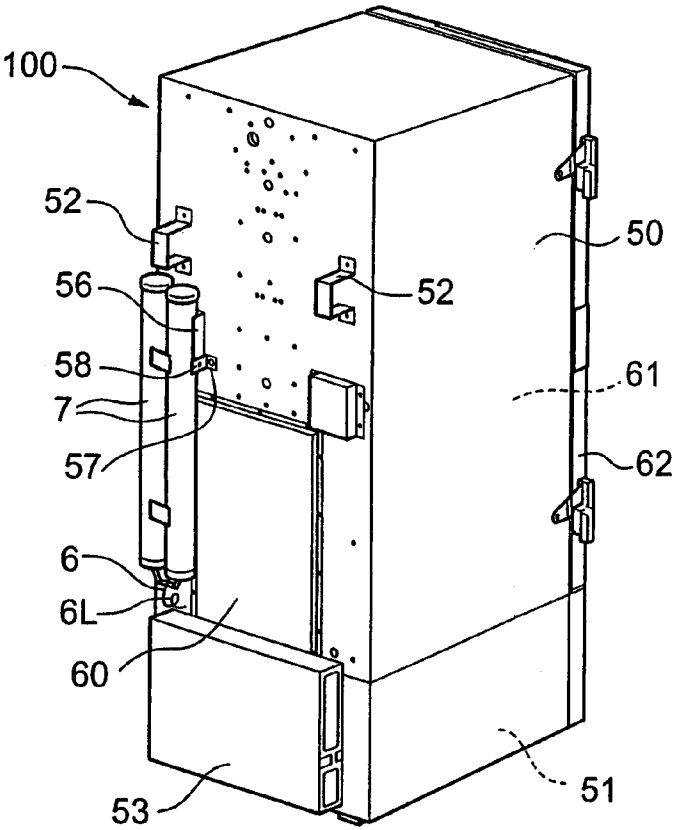
Figure 4A:
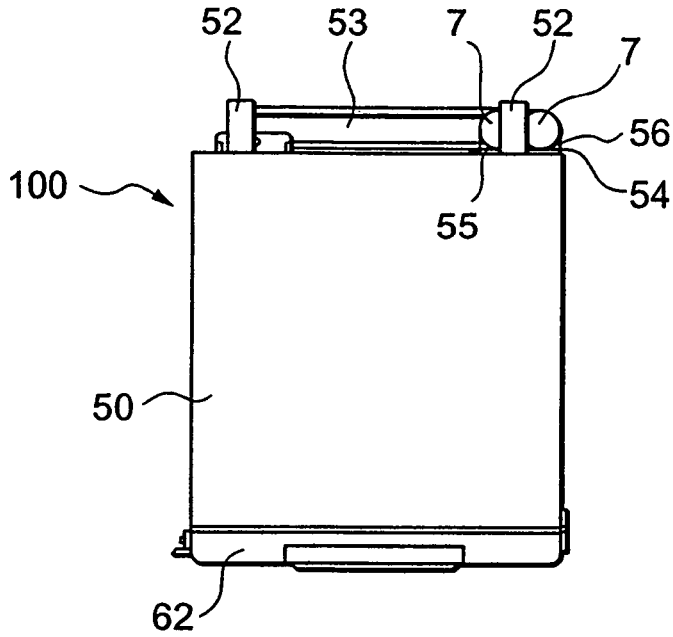
FIGS. 4A and 4B are plan explanatory views showing the third embodiment of the present invention.
Figure 4B:
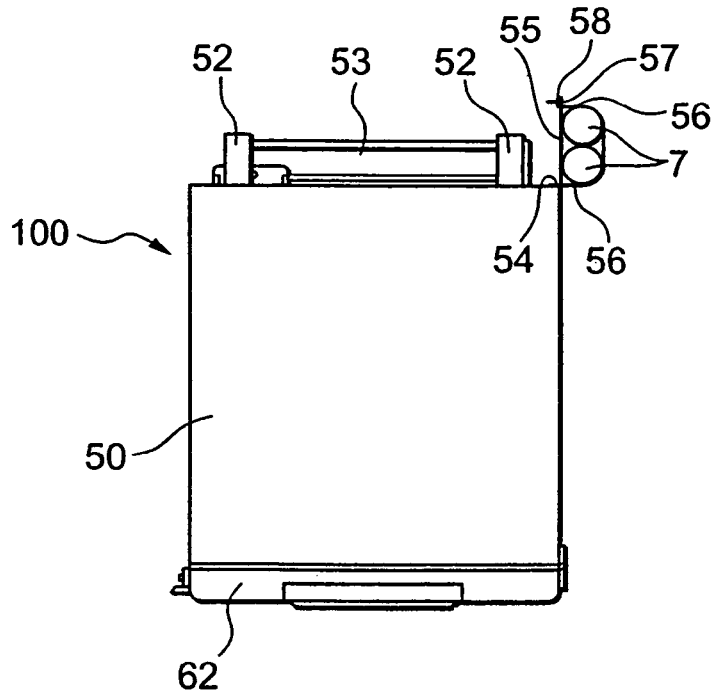

In a high-temperature side refrigerant circuit H of a binary refrigeration unit 100 of the present invention shown in FIG. 2, a compressor 1, a condenser 2, a pressure reducing valve 3 and an evaporator (refrigerant evaporation section) 4 are serially connected to form a circulation path of a refrigerant. A refrigerant tank 7 is connected to a low-pressure side of the circuit, i.e., a suction side of the compressor 1, through a connecting pipe 6 by interposing a capillary tube 5 as pressure reduction means. The connecting pipe 6 between the capillary tube 5 and the refrigerant tank 7 is connected to a high-pressure side of the circuit, i.e., a discharge side of the compressor 1, through a bypass pipe 9 by interposing a solenoid opening/closing valve 8.

A sum of an internal volume of the refrigerant tank 7, an internal volume of the connecting pipe 6 from the capillary tube 5 to the refrigerant tank 7, and an internal volume of the bypass pipe 9 from the solenoid opening/closing valve 8 to the connecting pipe 6 is 45% of a total internal volume of the high-temperature side refrigerant circuit H.

The high-temperature side refrigerant circuit H is filled with the predetermined amount of a mixed refrigerant in which R407D and pentane are mixed at a mass ratio of 94:6 so as to set a boiling point to about −45° C. per atmospheric pressure, and equilibrium pressure is adjusted to 658 kPa at +35° C. of outside air during a stop of an operation.

On the other hand, R508A (mixed refrigerant in which R23 and R116 (hexafluoroethane) as FC containing only fluorine and carbon are mixed at a mass ratio of 39:61) which boiling point is about −86° C. per atmospheric pressure is sealed in a low-temperature side refrigerant circuit L in which a compressor 11, a condenser (refrigerant condensation section) 12, a pressure reducing valve 13 and an evaporator 14 are serially connected, and a refrigerant tank 17 is connected to a refrigerant suction side of the compressor 11 through a connecting pipe 16 by interposing a capillary tube 15.

Hard alkyl benzene oil (HAB oil) is injected as refrigerating machine oil in the compressor 1 of the high-temperature side refrigerant circuit H and the compressor 11 of the low-temperature side refrigerant circuit L to improve lubricity, airtightness etc., on sliding portions of the compressors.

The binary refrigeration unit 100 is constructed in such a manner that the evaporator 4 of the high-temperature side refrigerant circuit H and the condenser 12 of the low-temperature side refrigerant circuit L are disposed side by side, and a refrigerant of the low-temperature side refrigerant circuit L can be cooled to be condensed at the condenser 12 by vaporization heat of a refrigerant of the high-temperature side refrigerant circuit H evaporated by the evaporator 4.

In this case, the binary refrigeration unit 100 comprises a controller 10 for opening the solenoid opening/closing valve 8 simultaneously with starting of the compressor 1, and closing the solenoid opening/closing valve 8 after passage of predetermined time (e.g., 1 to 3 min., variable) from the starting of the compressor 1.

Thus, even if the mixed refrigerant of R407D and pentane is sealed in the high-temperature side refrigerant circuit H so at to set the stop equilibrium pressure to 658 kPa, the solenoid opening/closing valve 8 is opened by the controller 10 simultaneously with the starting of the compressor 1, and a part of the refrigerant compressed by the compressor 1 to be discharged to the high-pressure side flows through the bypass pipe 9 into the refrigerant tank 7. Accordingly, a sudden increase in refrigerant pressure of the high-pressure side is prevented.

That is, in the binary refrigeration unit 100, since a considerable pressure increased of the high-pressure side can be suppressed at the time of starting the compressor 1, even if a compressor of a reciprocation type which reciprocates a piston to compress a refrigerant is used for the compressor 1 of the high-temperature side refrigerant circuit H, no large load is applied when the compressor 1 is stated.

In the conventional binary refrigeration unit 100X, it is necessary to use the compressor 1 which comprises, e.g., a motor of a rated voltage 220 V and rated consumption power 750 W. However, according to the binary refrigeration unit 100 of the described embodiment, the operation can be started by the compressor 1 which comprises, e.g., a compact motor of a rated voltage 115V and rated consumption power 600 W, and it is accordingly possible to reduce both of the amounts of power consumption and noise.

After passage of predetermined time (e.g., 1 to 3 min., variable) from the start of the compressor 1, the solenoid opening/closing valve 8 is closed to stop the supplying of the high-pressure refrigerant from the compressor 1 to the refrigerant tank 7. Thus, a refrigerant stored in the refrigerant tank 7 is gradually moved through the capillary tube 5 to the suction side of the compressor 1 to be used for a refrigeration operation. That is, after the passage of predetermined time from the start of the compressor 1, most of refrigerants stored in the refrigerant tank 7 are sucked through the connecting pipe 6 to the compressor 1.

Thus, the amount of a refrigerant compressed by the compressor 1 to be discharged, condensed at the condenser 2 and evaporated at the evaporator 4 is increased to a level approximately equal to that of the conventional binary refrigeration unit 100X when a refrigerant is sealed in the high-temperature side refrigerant circuit H so that stop equilibrium pressure can exceed 700 kPa, and high torque is required for starting the compressor 1. Accordingly, at the evaporator 4, sufficiently low cold of about −45° C. can be surely obtained as in the conventional case.

As a low temperature up to about −86° C. can be surely obtained at the evaporator 14 of the low-temperature side refrigerant circuit L, the binary refrigeration unit 100 of the embodiment can be used as a device for storing bacteria, blood components, bone marrow, clinical reagents, fungal threads, various cells, sperms, fertilized eggs, nucleic acids etc., in a cooled state.

The controller 10 can be constituted in such a manner that instead of being opened simultaneously with the starting of the compressor 1, the solenoid opening/closing valve 8 is opened before the starting of the compressor 1, in other words, the compressor 1 is started after the solenoid opening/closing valve 8 is opened.

As a peak value of high-pressure side pressure can be limited by opening the solenoid opening/closing valve 8 quickly after the compressor 1 is started, the controller 10 can be constituted in such a manner that the solenoid opening/closing valve 8 is opened within 30 sec. (preferably, within 15 sec.) after the starting of the compressor 1.

A constitution can be employed in which timing for closing the solenoid opening/closing valve 8 is decided by the controller 10 based on not passage of time after the starting of the compressor 1 but a temperature of the refrigerant evaporated at the evaporator 4 or the like to close the solenoid opening/closing valve 8.

For example, a constitution can be employed in which when temperature detection means installed in the evaporator 4 detects a predetermined reduction from a temperature at the time of starting the compressor 1, e.g., a reduction of 5° C., the solenoid opening/closing valve 8 is closed by the controller 10.

Additionally, timing for closing the solenoid opening/closing valve 8 can be decided based on pressure of a refrigerant circulated in the high-temperature side refrigerant circuit H. For example, a constitution can be employed in which when pressure detection means installed on the high-pressure side detects predetermined pressure, e.g., pressure of 2 MPa or lower, the solenoid opening/closing valve 8 is closed by the controller 10.

The controller 10 can be adapted to open the solenoid opening/closing valve 8 when the operation of the compressor 1 is stopped, and to close the solenoid opening/closing valve 8 after passage of predetermined time from the starting of the compressor 1.

Even if the controller 10 is constituted in the aforementioned manner, a pressure peak of the high-pressure side refrigerant at the time of starting the compressor 1 can be limited. Thus, a compressor which comprises a compact motor can be used for the compressor 1 even when the controller 10 is constituted in such a manner.

The solenoid opening/closing valve 8 may be a motor-operated valve a degree of which opening can be adjusted. As in the previous case, the capillary tubes 5, 15 may be replaced by pressure reducing valves such as electronic expansion valves or manual expansion valves.

As described above, according to the second embodiment of the present invention, since the operation can be started even by the compressor which comprises the small-torque and compact motor, it is possible to reduce power consumption and noise.

Incidentally, for example, as described above with reference to FIG. 1, the refrigerant tank 7 is connected to the low-pressure side of the high-temperature side refrigerant circuit H through the pressure reduction means such as the capillary tube 5, and the stop equilibrium pressure of the high-temperature side refrigerant circuit H is reduced to enable starting of the operation even by the compressor 1 which is the compressor equipped with the small-torque and compact motor.

However, if refrigerant tanks 7, 17 are disposed to be respectively connected through pressure reduction means to the low-pressure side of the high-temperature side refrigerant circuit H and the low-pressure side of the low-temperature side refrigerant circuit L, all the devices constituting the refrigerant circuits H, L cannot be housed in the case 50 of a conventional size. On the other hand, if the case 50 is enlarged to be able to house all the devices constituting the refrigerant circuits H, L, there is a problem of impossible carrying through a doorway of a general building into a laboratory, a storage room for storing bacteria, blood components, bone marrow, clinical reagents, fungal threads, various cells, sperms, fertilized eggs, nucleic acids etc., in a cooled state or the like.

Therefore, there is a need to manufacture a binary refrigeration unit constructed in such a manner that in order to enable reductions in the amounts of power consumption and noise, refrigerant tanks are connected through pressure reduction means to low-pressure sides of a high-temperature side refrigerant circuit and a low-temperature side refrigerant circuit, and stop equilibrium pressure in each refrigerant circuit is reduced to enable starting of an operation even by a compressor equipped with a small-torque and compact motor by using a case approximately equal in size to the conventional case, and this has been a task to be achieved.

Figure 7:
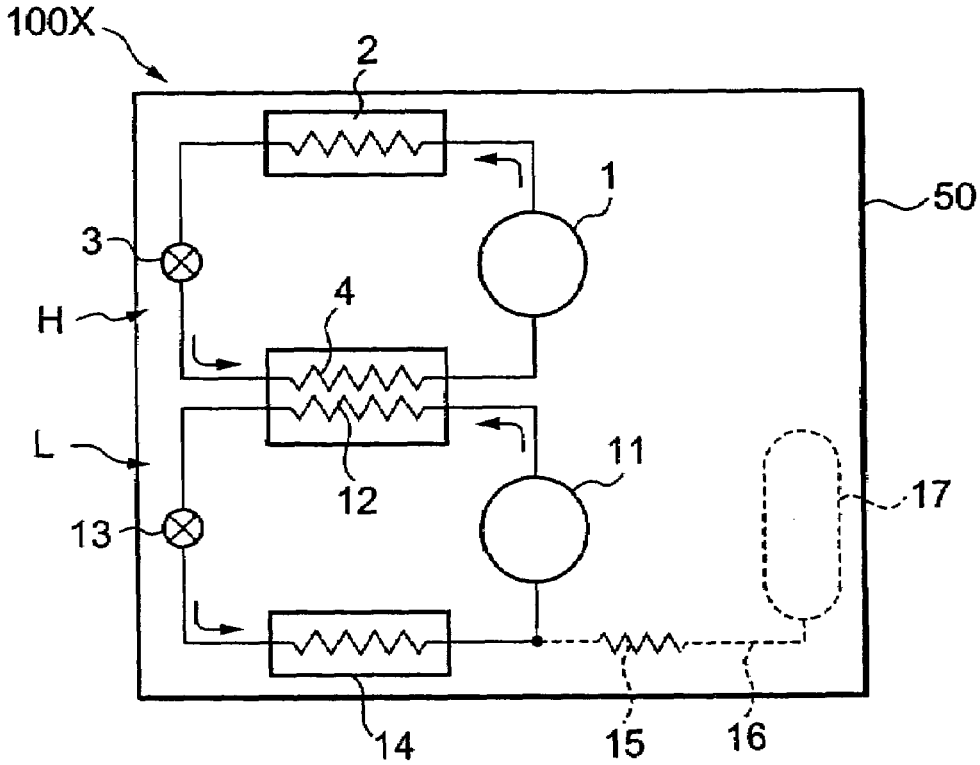
FIG. 7 PRIOR ART
FIG. 7 is another explanatory view showing a refrigerant circuit of a conventional binary refrigeration unit.

Thus, a specific structure of a binary refrigeration unit 100 of the present invention which achieves the foregoing task will be described as a third embodiment with reference to FIGS. 3A to 5. For easier understanding, portions having functions similar to those of the portions shown in FIG. 7 will be denoted by similar reference numerals in these drawings.

Figure 5:
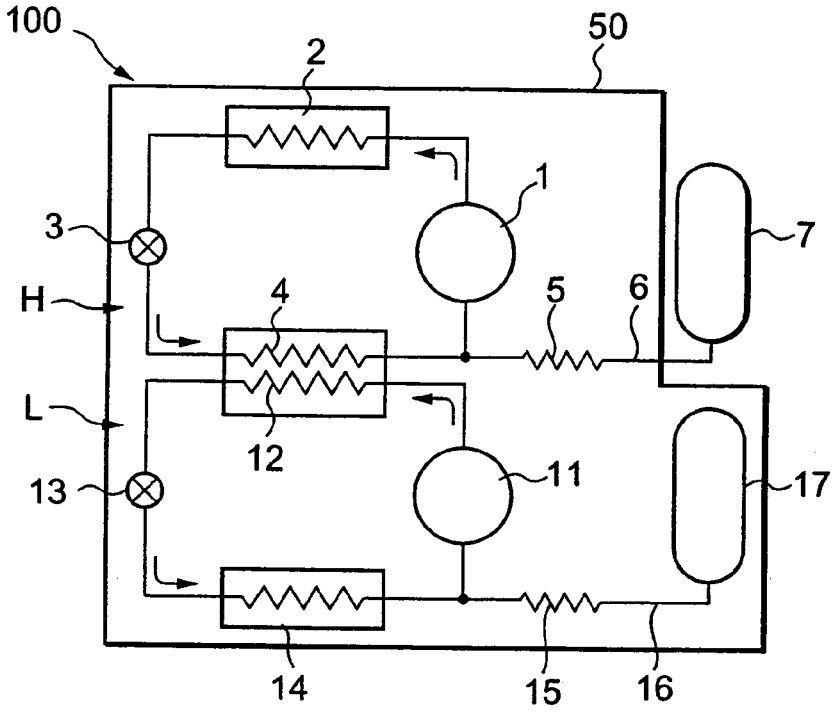
FIG. 5 is an explanatory view showing a refrigerant circuit of a binary refrigeration unit of FIGS. 3A, 3B, 4A and 4B.

In the binary refrigeration unit 100 of the embodiment, among devices constituting a binary refrigeration circuit (similar to that of FIG. 1) shown in FIG. 5, those other than a refrigerant tank 7 of a high-temperature side refrigerant circuit H are housed and installed in a device storage section 51 disposed on a lower side of a case 50 formed in a size equal to that of the conventional case, i.e., about 770 mm in width, about 900 mm in depth, and about 2000 mm in height, and the refrigerant tank 7 is attached to a backside of the case 50.

In the binary refrigeration unit 100 shown in FIGS. 3A to 4B, the refrigerant tank 7 is divided into two to be attached. Thus, a diameter of each refrigerant tank 7 can be set small even if an internal volume necessary between two wall abutting members 52 attached to the backside of the case 50 to reduce stop equilibrium pressure and a noise reduction cover 53 mounted on a lower side, for example, a sum of internal volumes of the two refrigerant tanks 7 and an internal volume of the connecting pipe 6 from the capillary tube 5 to the refrigerant tank 7, is set to, e.g., about 30% to 75% of a total internal volume of the high-temperature side refrigerant circuit H. Accordingly, the refrigerant tank 7 can be installed not to project backward from the wall abutting member 52.

The two refrigerant tanks 7 are fixed to a platelike tank mounting member 55 attached to be rotatable in a horizontal plane by twp hinges 54 arranged up and down on a backside left portion (seen from the backside) of the case 50 by a proper method, e.g., welding. The two refrigerant tanks 7 are attached to the backside left portion so as to be rotated in a left direction.

Metal fittings 56 erected in L shapes are disposed on both left and right sides of the tank mounting member 55. Rotation prevention means 58 equipped with a screw 57 is attached to the metal fittings 56 of a side to which the hinge 54 is not attached. The screw 57 is screwed into a screw hole 59 disposed on the backside of the case 50 to enable fixing of the tank mounting member 55 to the case 50 in a nonrotatable manner by the rotation prevention means 58, whereby the refrigerant tanks 7 can be surely attached to the backside of the case 50.

As described above, the two refrigerant tanks 7 attached to the backside of the case 50 are connected to the low-pressure side of the high-temperature side refrigerant circuit H through the connecting pipe 6 which comprises a loop 6L of a diameter of about 5 cm to 10 cm on the refrigerant tank 7 side. Accordingly, even if the connecting pipe 6 for connecting a lower end of the refrigerant tank 7 made of, e.g., iron (including stainless steel) to the backside of the case 50 is constituted of a copper pipe of an outer diameter of, e.g., about 6.35 mm, the connecting pipe 6 is not broken when the number of times of rotating the refrigerant tank 7 is about ten.

It is only when a backdoor 60 attached to the backside of the case 50 is opened to repair the devices stored in the device storage section 51 that the screw 57 of the rotation prevention means 58 is removed from the screw hole 59 to rotate the tank mounting member 55 by the hinge 54, thereby rotating the refrigerant tank 7 fixed to the tank mounting member 55. Thus, the number of times of opening the backdoor 60 is generally only about once or twice, almost never exceeding five times. Accordingly, the connecting pipe 6 constituted of the copper pipe can still be put to practical use as long as it is not broken even when it is used ten times.

A cooled article storage section 61 disposed on the device storage section 51 for storing bacteria, blood components, bone marrow, clinical reagents, fungal threads, various cells, sperms, fertilized eggs, nucleic acids, etc., in a cooled manner is opened/closed by a one-side opening door 62 attached by, e.g., a hinge.

According to the binary refrigeration unit 100 of the third embodiment of the present invention constructed in the foregoing manner, the refrigerant tank 7 of the high-temperature side refrigerant circuit H is attached to the backside of the case 50 formed in the size equal to the conventional case, i.e., about 770 mm in width, about 900 mm in depth and about 2000 mm in height, and the other devices constituting the binary refrigeration circuit are stored in the device storage section 51. Thus, the refrigeration unit can be easily carried through a doorway of a general building into a laboratory, a storage room for storing bacteria, blood components, bone marrow, clinical reagents, fungal threads, various cells, sperms, fertilized eggs, nucleic acids etc., in a cooled state, or the like.

The refrigerant tank 7 is attached to the backside of the case 50. However, since the refrigerant tank 7 is not projected backward from the wall abutting member 52, when the binary refrigeration unit 100 is pressed to the wall to be installed on the wall side, the refrigerant tank 7 is not abutted on the wall to be broken. Thus, the binary refrigeration unit 100 can be quickly installed without taking any meticulous care.

In this case, various modifications and changes can be made without departing from a spirit and a scope of the invention.

For example, a constitution can be employed in which the refrigerant tank 7 connected to the low-pressure portion of the high-temperature side refrigerant circuit H is stored in the device storage section 51, and the refrigerant tank 17 connected to the low-pressure portion of the low-temperature side refrigerant circuit L is attached to the backside of the case 50.

The refrigerant tank 7 (17) mounted on the tank mounting member 55 can be fixed by a metal band or the like, The connecting pipe 6 connected to the refrigerant tank 7 (17) attached to the backside of the case 50 may be divided into a portion to be disposed inside the case 50 and a portion to be disposed outside the case 50, and the two connecting pipes 6 may be connected to connection means having screws attached to a back plate (backside plate) of the case 50 by cap nuts or the like to be communicated with each other. When the refrigerant tank 7 (17) is rotated, the connecting pipe 6 located outside the case 50 and connected to the refrigerant tank 7 (17) may be removed from the connection means having screws, and the refrigerant tank 7 (17) may be rotated integrally with the connecting pipe 6 of the portion located outside the case 50.

A constitution can be employed in which proper fixing means comprising screws etc., for fixing to the wall or the like is disposed in the wall abutting member 52 to prevent falling of the binary refrigeration unit 100 when an earthquake occurs.

Additionally, the binary refrigeration unit 100 can be installed by disposing a recess of a size not to hinder heat insulation of the case 50.

As described above, according to the third embodiment of the invention, the binary refrigeration unit constructed in such a manner that in order to enable reductions in the amounts of power consumption and noise, the refrigerant tanks are connected through the pressure reduction means such the capillary tube to the low-pressure sides of the high-temperature side refrigerant circuit and the low-temperature side refrigerant circuit, and the stop equilibrium pressure in each refrigerant circuit is reduced to enable starting of the operation even by the compressor equipped with the small-torque and compact motor can be manufactured by using the case approximately equal in size to the conventional case. Thus, the binary refrigeration unit can be easily carried through a doorway of a general building into a laboratory, a storage room for storing bacteria, blood components, bone marrow, clinical reagents, fungal threads, various cells, sperms, fertilized eggs, nucleic acids etc., in a cooled state, or the like.

According to the third embodiment of the invention, since the refrigerant tank attached to the backside of the case is rotatable, when the backdoor disposed on the backside of the case is opened to repair the devices of the refrigerant circuits stored in the device storage section in the case or the like, it is possible to prevent inconveniences such as impossible opening/closing of the backdoor caused by interference of the refrigerant tank attached to the backside of the case.

According to the third embodiment of the invention in which the connecting pipe extended from the low-pressure side of the high-temperature side refrigerant circuit or the low-temperature side refrigerant circuit through the back plate of the case is connected to the refrigerant tank attached to the backside of the case through the loop, even if the connecting pipe for connecting the refrigerant tank made of, e.g., iron (including stainless steel) to the backside of the case is constituted of, e.g., a copper pipe, deformation of the connecting pipe during rotation is absorbed by the loop portion. Thus, the connecting pipe is not broken as long as the number of times of rotating the refrigerant tank is about 10.

According to the third embodiment of the invention in which the refrigerant tank of the high-temperature side or the low-temperature side attached to the backside of the case is divided into plural portions, even if a total internal volume of the refrigerant tanks attached to the backside of the case is increased in order to reduce stop equilibrium pressure, a diameter of each refrigerant tank can be reduced. Thus, it is possible to reduce a size back and forth.

According to the invention in which the refrigerant tank of the low-temperature side is installed in the case, and the refrigerant tank of the high-temperature side is attached to the back side of the case, the binary refrigeration unit can be manufactured by arranging the low-temperature side refrigerant circuit completely similarly to the conventional case, arranging the high-temperature side refrigerant circuit almost similarly to the conventional case, and only connecting the refrigerant tank attached to the backside of the case to the low-pressure side of the high-temperature side refrigerant circuit arranged in the case through the pressure reduction means disposed in the case. Thus, the binary refrigeration unit can be manufactured without greatly changing conventional manufacturing steps or used members.

Furthermore, according to the invention in which the wall abutting member having its rear end located in the rear of the refrigerant tank attached to the backside of the case is attached to the backside of the case, since the refrigerant tank is not projected backward from the wall abutting member, even when the binary refrigeration unit is pressed to the wall to be installed on the wall side, the refrigerant tank is not abutted on the wall to be broken. Thus, according to the third embodiment of the invention, the binary refrigeration unit can be quickly installed without taking any meticulous care.

What is claimed is:

1. A binary refrigeration unit comprising:

a refrigerant condensation section of a low-temperature side refrigerant circuit, and a refrigerant evaporation section of a high-temperature side refrigerant circuit disposed side by side with the refrigerant condensation section of the low-temperature side refrigerant circuit, the refrigerant condensation section of the low-temperature side refrigerant circuit being cooled by cold generated at the refrigerant evaporation section of the high-temperature side refrigerant circuit to condense a refrigerant of the low-temperature side refrigerant circuit at the refrigerant condensation section, wherein:

a refrigerant tank is connected to a low-pressure side of the high-temperature side refrigerant circuit through a connecting pipe equipped with pressure reduction means; and a high-pressure side of the high-temperature side refrigerant circuit and the refrigerant tank are connected to each other through a bypass pipe equipped with opening/closing means.

2. The binary refrigeration unit according to claim 1, further comprising:

control means for opening the opening/closing means of the bypass pipe at the time of starting a compressor disposed in the high-temperature side refrigerant circuit, and for closing the opening/closing means after passage of predetermined time or detection of a preset value of a physical amount.

3. The binary refrigeration unit according to claim 1 or 2, further comprising:

control means for opening the opening/closing means of the bypass pipe at the time of stopping the compressor disposed in the high-temperature side refrigerant circuit, and for closing the opening/closing means after passage of predetermined time from a start of the compressor or detection of a preset value of a physical amount.

4. A binary refrigeration unit in which a refrigerant condensation section of a low-temperature side refrigerant circuit and a refrigerant evaporation section of a high-temperature side refrigerant circuit housed in a case are disposed side by side; and the refrigerant condensation section of the low-temperature side refrigerant circuit is cooled by cold generated at the refrigerant evaporation section of the high-temperature side refrigerant circuit to condense a refrigerant of the low-temperature side refrigerant circuit at the refrigerant condensation section, the binary refrigeration unit comprising:

a high-temperature side refrigerant tank connected to a low-pressure side of the high-temperature side refrigerant circuit through pressure reduction means; and a low-temperature side refrigerant tank connected to a low-pressure side of the low-temperature side refrigerant circuit through pressure reduction means, wherein one refrigerant tank is installed in the case; and the other refrigerant tank is attached to a backside of the case.

5. A binary refrigeration unit in which a refrigerant condensation section of a low-temperature side refrigerant circuit and a refrigerant evaporation section of a high-temperature side refrigerant circuit housed in a case are disposed side by side, and the refrigerant condensation section of the low-temperature side refrigerant circuit is cooled by cold generated at the refrigerant evaporation section of the high-temperature side refrigerant circuit to condense a refrigerant of the low-temperature side refrigerant circuit at the refrigerant condensation section, the binary refrigeration unit comprising:

a high-temperature side refrigerant tank connected to a low-pressure side of the high-temperature side refrigerant circuit through pressure reduction means; and a low-temperature side refrigerant tank connected to a low-pressure side of the low-temperature side refrigerant circuit through pressure reduction means, wherein one refrigerant tank is installed in the case; and the other refrigerant tank is mounted on a tank mounting member rotatably mounted on a backside of the case to be rotatably attached to the backside of the case.

6. The binary refrigeration unit according to claim 5, wherein a connecting pipe extended from the low-pressure side of the high-temperature side refrigerant circuit or the low-temperature side refrigerant circuit through a back plate of the case is connected through a loop to the refrigerant tank attached to the backside of the case.

7. The binary refrigeration unit according to any one of claims 4 to 6, wherein the refrigerant tank of the high-temperature side or the low-temperature side attached to the backside of the case is divided into plural portions.

8. The binary refrigeration unit according to any one of claims 4 to 6, wherein the low-temperature side refrigerant tank is installed in the case; and the high-temperature side refrigerant tank is attached to the backside of the case.

9. The binary refrigeration unit according to any one of claims 4 to 6, wherein a wall abutting member whose rear end is positioned in the rear of the refrigerant tank attached to the backside of the case is attached to the backside of the case.

10. The binary refrigerant unit according to claim 1 further comprising:

a low-temperature side refrigerant tank connected to a low-pressure side of the low-temperature side refrigerant circuit through pressure reduction means, wherein one refrigerant tank is installed in the case and the other refrigerant tank is attached to a backside of the case; and wherein one refrigerant tank is installed in the case and the other refrigerant tank is mounted on a tank mounting member rotatably mounted on a backside of the case to be rotatably attached to the backside of the case.

11. The binary refrigeration unit according to claim 10, wherein a connecting pipe extended from the low-pressure side of the high-temperature side refrigerant circuit or the low-temperature side refrigerant circuit through a back plate of the case is connected through a loop to the refrigerant tank attached to the backside of the case.

12. The binary refrigeration unit according to claim 10, further comprising:

control means for opening the opening/closing means of the bypass pipe at the time of stopping the compressor disposed in the high-temperature side refrigerant circuit, and for closing the opening/closing means after passage of predetermined time from a start of the compressor or detection of a preset value of a physical amount.

* * * * *